United States Patent [19]

Baus

[11] 4,327,451

[45] May 4, 1982

[54] WATER-CLOSET OR BIDET

[76] Inventor: Heinz G. Baus, Ulmenweg 46, Thun, Switzerland

[21] Appl. No.: 131,011

[22] Filed: Mar. 17, 1980

[30] Foreign Application Priority Data

Mar. 27, 1979 [DE] Fed. Rep. of Germany ..... 2912084

[51] Int. Cl.[3] ..... A61H 35/00; E03D 9/08

[52] U.S. Cl. ..... 4/420.2; 4/420.4; 4/447

[58] Field of Search ..... 4/443–448, 4/420.1–420.5, 213, 217, 615, 249–251; 137/616.7; 128/229

[56] References Cited

U.S. PATENT DOCUMENTS

| | | | |
|---|---|---|---|
| 1,187,759 | 6/1916 | Manahan | 4/420.2 |
| 1,583,173 | 5/1926 | Price et al. | 137/616.7 X |
| 1,935,201 | 11/1933 | Callejo | 4/448 |
| 2,278,055 | 3/1942 | Bigio | 4/448 |
| 2,707,486 | 5/1955 | Johns | 137/616.7 X |
| 2,875,450 | 3/1959 | Umann | 4/420.2 X |
| 3,528,075 | 9/1970 | Leon | 4/251 |
| 3,545,015 | 12/1970 | Richardson, Jr. et al. | 4/447 |
| 3,925,826 | 12/1975 | Huyot et al. | 4/420.4 |

FOREIGN PATENT DOCUMENTS

| | | | |
|---|---|---|---|
| 2124660 | 12/1971 | Fed. Rep. of Germany | 4/443 |
| 2500345 | 7/1976 | Fed. Rep. of Germany | 4/420.4 |

*Primary Examiner*—Stuart S. Levy

*Attorney, Agent, or Firm*—Schwartz, Jeffery, Schwaab, Mach, Blumenthal & Koch

[57] ABSTRACT

A water closet or bidet comprises an arrangement for washing the lower parts of the body, and a spraying device by means of which preheated water is applied to the parts of the body to be cleansed. The spraying arrangement comprises at least one spray nozzle, which is supplied with preheated water by means of connecting elements. The connecting elements include a rotatable body (54, 154) rotatingly supported in a pedestal body (104, 152), provided with a blind bore hole (100) traversed by a transverse bore hole (102) and open toward the spray nozzle (34, 35). The pedestal body (104, 152) has an inlet orifice (110) in the area of the transverse bore (102), through which the spray nozzle is supplied with wash water via the transverse bore and the blind hole. The pedestal body has a channel (108) in the region of the inlet orifice which overlaps the rotating range of the transverse bore so that in one position of the rotating body the entire inlet cross section (92) and in another position of the rotating body only a portion of the inlet cross section (91) is open.

5 Claims, 7 Drawing Figures

WATER-CLOSET OR BIDET

Figure 1:
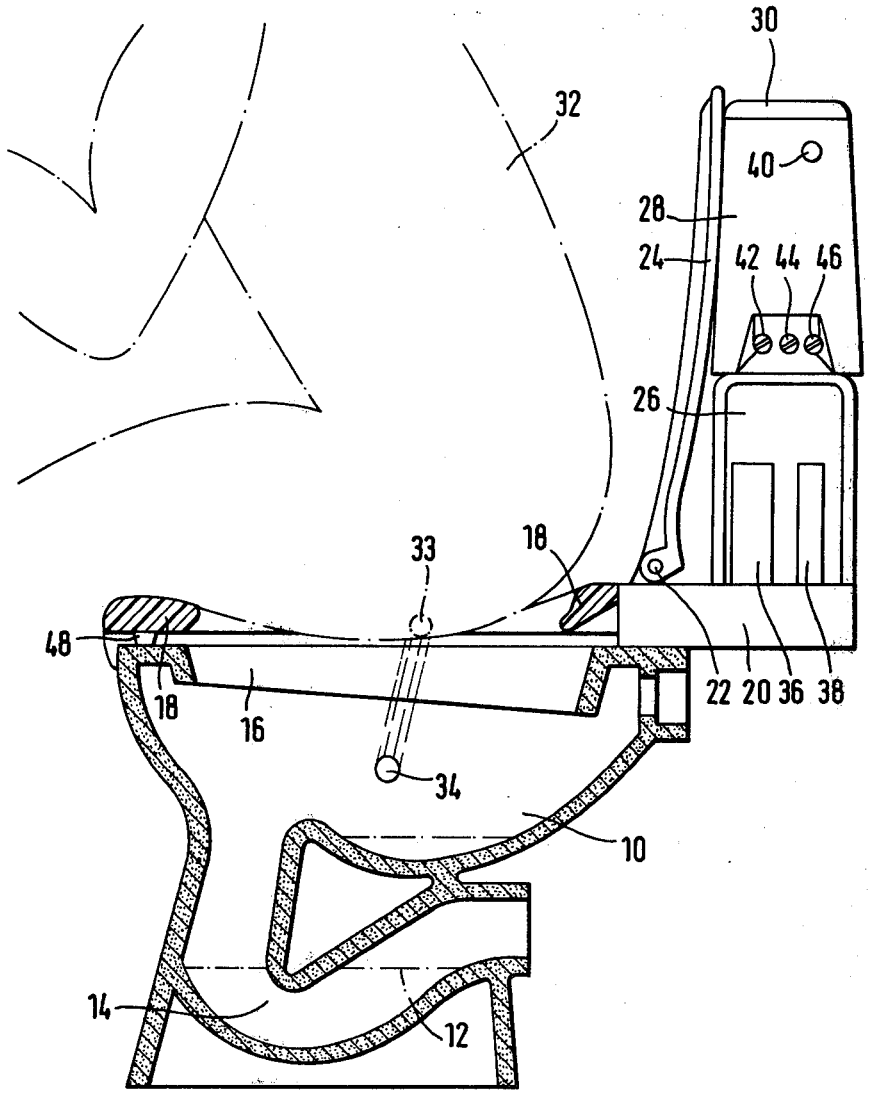

The invention concerns a water closet or bidet with a device for the washing of the lower parts of the body and having a spray device, by means of which the preheated water is conveyed to the parts of the body to be cleansed, wherein the spray device comprises at least one spray nozzle capable of receiving the preheated water by way of connecting means.

Various arrangements of the above-described type are known. For example, closet installations of this kind may have stationary washing and drying devices, U.S. Pat. No. 2,875,450, DE-OS No. 21 24 660, U.S. Pat. No. 3,545,015). The spray device therein is either arranged in a stationary manner or is, as known from DE-OS No. 25 00 345, connected with the seat and capable of being rotated into the anal region.

All of these installations comprise a water heater, arranged in most cases in the area of the water tank. In general, when actuating the spray device, a valve is opened, whereby the preheated water in the water tank, or water heater, is conducted to the nozzle of the spray device. The problem lies in that in the region between the valve and the water heater there is always a standing volume of water, which under certain conditions may be cold, but at the most is at room temperature. When the valve is opened, the water initially applied to the lower part of the body is relatively cool, which may cause a disagreeable sensation.

This same problem also occurs with bidets wherein, however, the spray nozzle is located stationarily in the approximate center of the bowl.

It is the object of the invention to improve a water closet or bidet of the above-mentioned type, so that only warm water will be applied to the parts of the body to be washed.

The object is attained according to the invention in that the connecting means comprise at least one rotatable body rotatingly supported in a pedestal body, the rotatable body having a blind bore hole, opening in the direction of the spray nozzle and penetrated by a transverse bore, that the pedestal body has an inlet orifice in the region of the transverse bore through which the spray nozzle may receive wash water via the transverse bore and the blind bore hole, and that the pedestal body in the region of the inlet orifice and in the rotational range of the transverse bore has a channel covering the rotational range of the transverse bore in such a manner that in one position of the rotatable body the entire inlet cross section and in another position of the rotatable body only a portion of the inlet cross section is open.

When the arrangement is used in a water closet, in which it is not possible to provide a stationary spray nozzle, a preferred embodiment of the invention may consist in mounting the spray nozzle on the end of a swivel arm pivotable into a position inside the bowl (or the mounting of each of a plurality of spray nozzles on a respective swivel arm), in securing the swivel arm to the rotatable body so that the blind bore hole opens into the swivel arm, and that the rotatable body serves as the bearing element for the swivel arm.

The embodiment of the rotatable body or of the rotatable body serving as a bearing element thus has the effect that the cold water or at least the water sensed as being cold and located in the pipeline between the hot water heater or the continuous flow heater is initially forced out of the spray nozzle, from which, because of the reduced cross section, no jet of water may develop. This prevents the spraying of cold water toward the part of the body to be washed. This initially small cross section is increased after a certain period of time (the period of time required to run out the cold water), or (in the case of a water closet with swivel arms) following the outward rotation of the swivel arms, to the full cross section of the inlet orifice, so that warm water may be sprayed from the spray nozzles or spray nozzle.

The invention shall hereinafter be described and explained in more detail with the aid of the drawings, in which an embodiment of the invention is illustrated.

Figure 2:
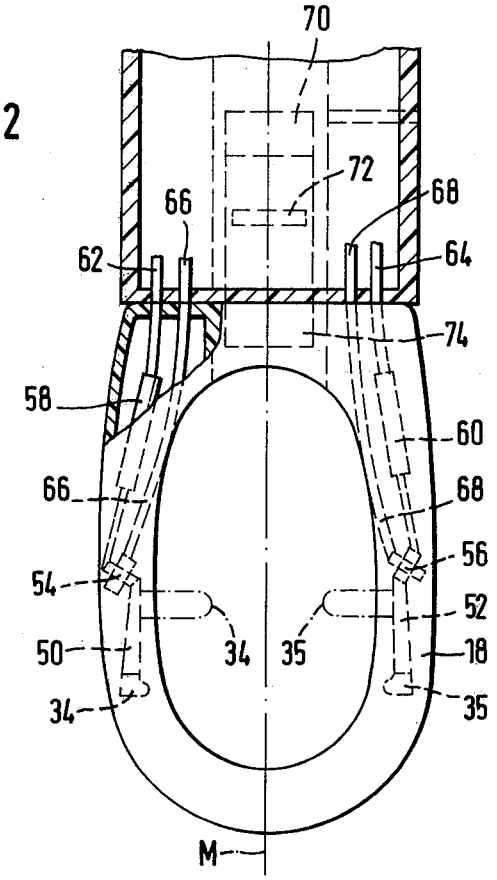
Figure 5:
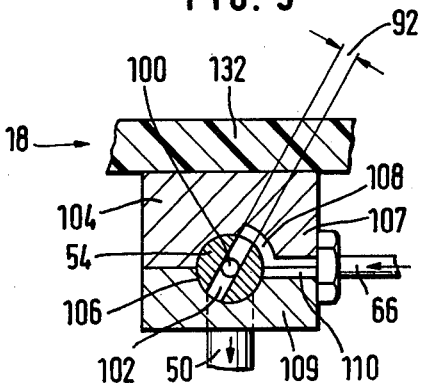
Figure 6:
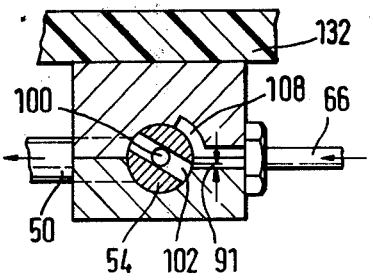
Figure 3:
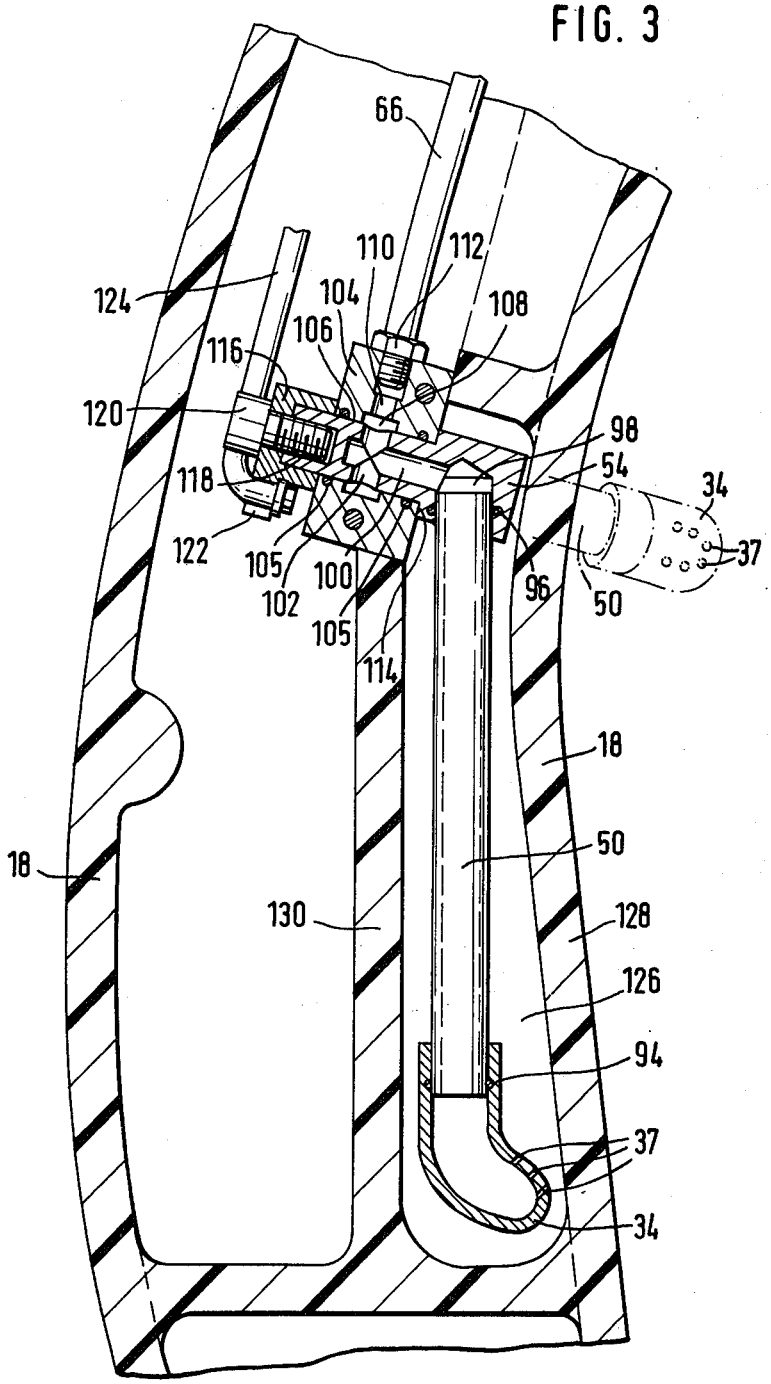
Figure 4:
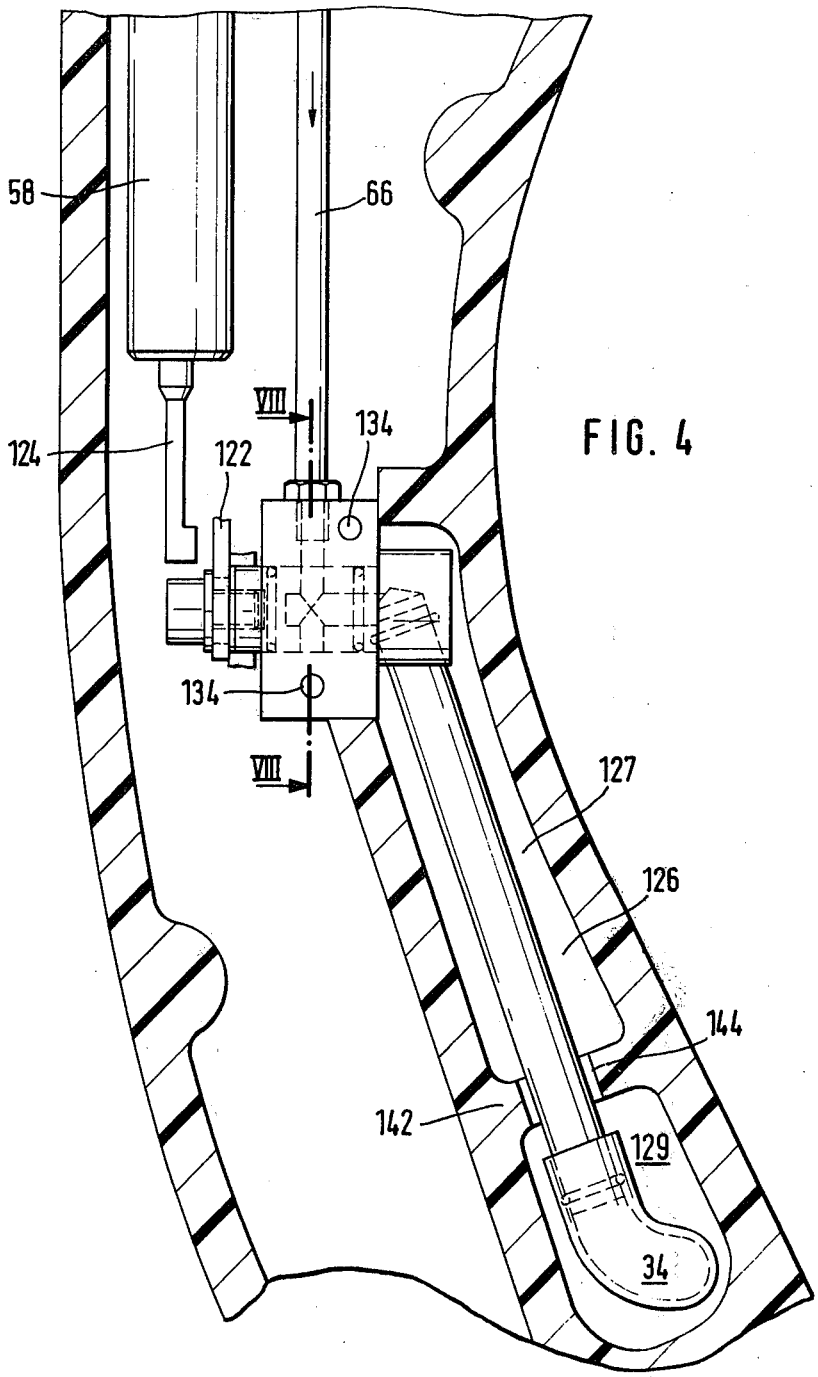
Figure 7:
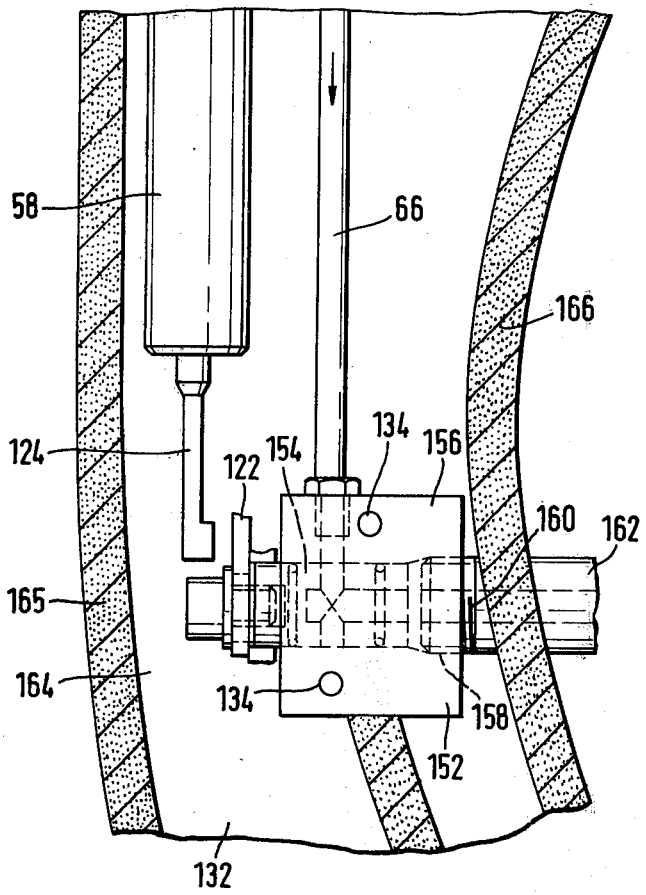

In the drawing:

FIG. 1 shows a schematic representation of the water closet in cross-section, FIG. 2 a top view of the water closet, FIG. 3 a sectional bottom view of an annular seat, FIG. 4 a bottom view similar to that in FIG. 3, in another embodiment, FIGS. 5 and 6 a partial sectional view along line VIII—VIII through the object of FIG. 4, with two different positions of the bearing element carrying a swivel arm, and FIG. 7 a view similar to that of FIG. 4, of a stationary spray device in a bidet.

FIG. 1 shows a diagrammatic sketch of a water closet with a bowl 10 and a liquid trap 12, containing water 14. An annular seat 18 is located above the rim 16 of the bowl and is hingedly mounted on a tank 20 by means of a hinge (not shown). A lid 24 is hingedly connected above the tank 20 by means of a further hinge 22. Behind the lid 24 is a lower part 26 of the tank, and over it the water tank 28. The water tank is closed with a cover 30. The anal region 33 of a person 32 seated on the annular seat 18 is cleansed by means of spray nozzle 34. Inside the lower tank part 26 there is a block 36 to control further processes to be described hereinbelow and also a continuous flow heater 38; one lateral wall of the lower tank part has been omitted so the block 36 and the flow heater 38 are visible. The rinsing process for the flushing of the closet is actuated by means of a flushing knob 40. From the outside, three rotatable knobs 42, 44 and 46 are visible on the water tank 28, by means of which the duration of the washing and drying cycles are regulated. Because the washing process and the drying processes are both controlled electronically or electrically, a switch must be provided to activate the installation; this function is performed by a switch 48, arranged beneath the annular seat between the upper rim 16 of the bowl and the seat 18 and actuated by the weight of the person 32 on the seat.

FIG. 2 shows a top view of the flush toilet, or water closet, of FIG. 1, with the seat 18 turned down, the lid 24 eliminated and certain parts broken away.

The spray nozzles 34 and 35 are arranged on the two longer inner sides of the oval seat 18. Each spray nozzle 34, 35 is mounted on a respective swivel arm 50, 52, which is in turn supported rotatingly on a respective bearing element 54, 56, on the seat 18 and which may be actuated by means of a respective piston and cylinder arrangement 58, 60. In FIG. 2, the spray nozzles 34 and 35 are shown in broken lines, rotated in the bowl to their rest position; in their position rotated into the bowl, the spray nozzles 34 and 35 are outside the center line M of the bowl 10.

The two piston-cylinder arrangements are actuated with water; this water is supplied to them by way of control valves, not shown, and respective line 62, 64.

The spray nozzles 34, 35 are supplied with water by means of respective lines 66, 68, as will be explained further below. The continuous flow heater shown in FIG. 1 is connected with lines 66 and 68, so that the water to be sprayed is maintained at body temperature. By means of suitable control devices, which may be regulated by means of the rotatable knobs 42 to 46, the temperature of the water introduced may be adjusted.

Following the completion of the flushing and the spraying process, a fan 70 is actuated which blows air heated by means on an infrared lamp or a heat source 72, through a channel 74 into the bowl 10 in order to effect the drying process in the anal region 33.

Water is supplied to the spray nozzles 34, 35 and the piston-cylinder arrangements by way of hoses 62, 64 and 66, 68. These hoses consist of flexible and elastic lines, for example of a synthetic plastic material, and must be located suitably so that squeezing, pulling and resultant tearing during the lifting and lowering of the seat 18 will be prevented.

In FIG. 3, the seat 18 is illustrated in a bottom view. The swivel arm 50, provided in the form of tubing, is seen, with the spray nozzle, or shower head 34, slid onto the end of the tubing with an interposed gasket 94. The spray nozzle 34 has small orifices 37, through which the water may be sprayed. The swivel arm 50 with spray nozzle 34 is shown in broken lines in the outwardly rotated position.

The swivel arm 50 is set (with the insertion of a gasket 96) into a bore hole 98 in the bearing element 54. The bore 98 extends into a blind hole 100, which in turn is traversed by a transverse bore 102. In the stationary bearing 104 proper, a transverse bore 106 is arranged, in which the bearing element 54 is supported rotatingly, with the insertion of gaskets 105. The transverse bore 106 widens in the region of transverse bore 102 into a supply channel 108, connected in turn with an inlet orifice 110. The inlet orifice 110 extends transversely to the transverse bore 106 and is connected with the line 66 by means of a threaded connection 112. The bearing element 54 has a step 114 in its inner region, and extends through and projects past the stationary bearing 104. To secure the bearing element 54 to the stationary bearing (also referred to as "pedestal body") 104 and to prevent axial shifting, a pot-like retaining member 116 is provided; it engages the end of the bearing element 54 projecting past the lateral surface of the bearing 104, and is fastened to the bearing element 54 by means of a threaded connection 118. The retaining member 116 has a radially extending projection 122, on which a rod 124 is mounted for the purpose of rotating the bearing element 54 and thus swivelling the swivel arm 50, which in turn carries the spray nozzle 34. It is seen that the swivel arm 50, together with the spring nozzle 34, is housed in a cavity 126 open in the downward direction, i.e. toward the closet bowl 10, the cavity being closed off inwardly by an inner wall 128 and outwardly by means of a centrally located web 130 in the seat 18.

A further embodiment is shown in FIG. 4. It is seen that the cavity 126 is divided into a larger space 127 and a smaller space 129. A spray nozzle 34 is arranged in the smaller space 129. The spaces are separated from each other by a partition 142 which has a recess 144 for guiding the swivel arm 50.

FIGS. 5 and 6 show a cross section taken along line VIII—VIII of FIG. 4. The bearing 104 is mounted on the upper wall area 132 of the seat 18, the bearing comprising two split bush sections 107 and 109, held together for example by means of threaded bolts 134 (see FIG. 4). Within the bearing element 54 can be seen 1. The transverse bore 102 extending in the plane of the drawing,
2. The blind hole 100, extending perpendicular to the plane of the drawing.

The inlet orifice 110, in communication with the line 66, opens into the channel 108. The swivel arm 50, shown in FIG. 6 partially in its inwardly rotated rest position, is connected with the bearing element 54; the transverse bore 102 of the latter is positioned so that only a small cross section 91 is open. In the outwardly rotated position according to FIG. 5, the entire cross section 92 of the transverse bore 102 is open, so that the full volume of the water may run through. The reasons for this arrangement lies in that if the cross section 92 were zero, there would be water in the supply line, so that upon the onset of the spraying process, cold water would be applied to the lower parts of the body. To prevent this from happening, a certain volume of water is first ejected through the line 66 and the spray nozzle, so that the cold water still in the line is eliminated. The swivelling motion in the outward direction begins only when there is actually warm water in the spray nozzle. It is possible to detect the presence of warm water in the area of the spray nozzle and to actuate the swivelling process to coincide with the increase in the temperature of the water; it is obviously also possible to delay the onset of the swivelling process with respect to the commencement of spraying until hot water arrives normally at the spray nozzle. This period of time may be readily determined from the cross sections of the lines and from the cross sections 91 and 92.

The arrangement shown in FIGS. 5 and 6 functions in the following manner:

The water flowing through the line 66, in the direction of the arrow drawn in that line, may flow into the transverse bore 102 of the revolving body 54 only through the slight restricting cross section 91. From the transverse bore 102, the water continues to flow into the blind hole 100 extending perpendicularly to the plane of the drawing. From the blind hole 100, the water flows into and through the swivel arm 50 in the direction of the illustrated arrow, to the spray nozzle 34. Water flows through the spray nozzle sluggishly, because the pressure acting on the water at the spray nozzle has been reduced by the small restricting cross section 91. Thus, in the rest position shown in FIG. 6, the cold water standing in the supply system will be discharged first.

Once the cold water has been discharged, the swivel arm 50 is rotated inside the bowl. The revolving body 54, fixedly connected with the swivel arm 50, is thereby rotated into the position shown in FIG. 5. In the position of FIG. 5, the heated water flows through line 66 and inlet orifice 110 into channel 108 surrounding revolving body 54 over the range of the swivelling angle. The heated water flows from this channel 108 over the entire inlet cross section 92 into the transverse bore 102 and passes on without hindrance, and thus at full pressure, via the blind hole 100 and the swivel arm 50 to the spray nozzle 34. The warm water is thus sprayed out, in the outwardly swivelled position of FIG. 5, at the full pressure required for cleansing.

FIG. 7 shows an embodiment of the invention similar to that of FIG. 4. Herein, the spraying device is arranged with its spray nozzle fixed in place, or stationary, in the center of the bidet bowl 164, of which two walls 165, 166 surrounding the rim of the bowl are seen. This stationary arrangement may be used only in a bidet and not in a closet. A pedestal body 152, corresponding to pedestal body 104, is located between the walls 165 and 166 and houses a rotatable body 154 corresponding to the rotatable body, or bearing element, 54 of FIGS. 3 and 4. The pedestal body 152 has an extension 156 provided with a threaded bore 158 which extends into a bearing surface for the rotatable body. The threaded section 160 of a tube section 162 is screwed into the threaded bore in the pedestal body 152. The tube 162 continues inwardly toward the spray nozzle. The construction of the pedestal body and of the rotatable body otherwise corresponds with that of the rotatable or bearing element 104, so that further details thereof need not begin here.

List of Reference Symbols

| | | | |
|---|---|---|---|
| 10 | bowl | 98 | bore hole |
| 12 | liquid trap | 100 | blind hole bore |
| 14 | water in trap | 102 | transverse bore |
| 16 | rim of bowl | 104 | stationary bearing, pedestal body |
| 18 | (toilet) seat | 105 | gasket |
| 20 | tank | 106 | transverse bearing bore |
| 22 | hinge | 107 | split bush section |
| 24 | lid | 108 | inlet channel |
| 26 | lower part of tank | 109 | split bush section |
| 28 | water tank, water container | 110 | inlet orifice |
| 30 | cover cap | 112 | threaded connection |
| 32 | person | 114 | step |
| 33 | anal region | 116 | retaining member |
| 34, 35 | spray nozzle | 118 | threaded connection |
| 36 | block | 122 | projection |
| 37 | orifices | 124 | rod |
| 38 | continuous flow heater | 126 | cavity |
| 40 | flushing knob | 127, 129 | space |
| 42, 44 | rotatable knobs | 128, 130 | wall |
| 46 | | 132 | wall area |
| 48 | switch | 134 | threaded bolts |
| 50, 52 | swivel arm | 142 | partition |
| 54, 56 | bearing element, rotatable body | 144 | recess |
| 58, 60 | piston-cylinder arrangement | 152 | pedestal body |
| 62, 64 | hose, line | 154 | rotatable body |
| 66, 68 | hose, line | 156 | extension |
| 70 | fan, blower | 158 | threaded bore |
| 72 | heat source | 160 | threaded pipe |
| 74 | air channel | 162 | tube section |
| 91, 92 | cross section | 164 | bidet bowl |
| 94, 96 | gasket | 165, 166 | wall |

-continued

List of Reference Symbols

| | |
|---|---|
| M | center line |

What is claimed is:

1. Water closet or bidet with a device for washing the lower parts of a users body comprising a spraying device comprising at least one spray nozzle by means of which preheated water may be sprayed on the parts of the body to be cleansed, said spray nozzle being supplied with preheated water through connecting elements comprising a rotatable body rotatably supported in a stationary body; said rotatable body being provided with a blind bore hole and a transverse bore penetrating said blind bore hole, the open end of said blind bore hole communicating with said spray nozzle; said spray nozzle being pivotable between a first position in which the spray nozzle is extended into the bowl of the water closet or bidet and a second position in which said spray nozzle is retracted out of the bowl by means of a piston and cylinder arrangement operatively connected to said rotatable body by means of a rod; said stationary body being provided with an inlet opening and a channel extending from said inlet opening to the region of said transverse bore, whereby preheated water may be supplied to said spray nozzle via said inlet, said channel, said transverse bore and said blind bore hole; said channel overlapping the range of rotation of said transverse bore to such an extent that when said spray nozzle is pivoted to said first position, the full area of the transverse bore is open to said channel, and when the spray nozzle is pivoted to said second position, only a portion of the transverse bore is open to said channel.

2. Water closet according to claim 1, characterized in that said at least one spray nozzle (34, 35) is mounted on the end of a swivel arm (50, 52) pivotable into the bowl (10), that the at least one swivel arm is mounted on the rotatable body (54) so that the blind hole (100) opens into the swivel arm (50, 52) and that the rotatable body (54) serves as the bearing element for the existing swivel arm (50, 52).

3. Apparatus according to claim 1 wherein said inlet in said stationary body is aligned with the transverse bore in said rotatable body.

4. Apparatus according to claim 1 wherein a retaining member is provided for securing said rotatable body in said stationary body, and said rod engages said cylinder arrangement to said rotatable body.

5. Apparatus according to claim 1 wherein said piston and cylinder arrangement is driven by water pressure.

* * * * *